US005099737A

United States Patent [19]

Curletto

[11] Patent Number: 5,099,737

[45] Date of Patent: Mar. 31, 1992

[54] DOUBLE CHAMBERED BASSBOARD HOUSING FOR ELECTRONIC M.I.D.I. ACCORDION WITH RETRACTABLE KEYBOARD

[76] Inventor: Giorgio F. Curletto, 6109 Nevada Ave., NW., Washington, D.C. 20015

[21] Appl. No.: 659,733

[22] Filed: Feb. 22, 1991

[51] Int. Cl.[5] ..... G10D 11/00

[52] U.S. Cl. ..... 84/376 R

[58] Field of Search ..... 84/376 R, 376 A, 376 EA, 84/376 K, 376 SM, 177, 352, 354

[56] References Cited

U.S. PATENT DOCUMENTS 4,641,565 2/1987 Tachida et al. ..... 84/177

4,953,436 9/1990 Curletto ..... 84/376 A

*Primary Examiner*—L. T. Hix

*Assistant Examiner*—Eddie C. Lee

[57] ABSTRACT

A double chambered bassboard housing for electronic M.I.D.I. accordion incorporating a folding control panel and a retractable keyboard. In a fully open position the instrument, because of its light weight and curved contour, is ideal to play and to perform with. Furthermore, all the push buttons on the folding control panel (in a fully open position) are readily identifiable because well within the view field of the accordionist. In a fully closed position the instrument becomes even more compact and therefore extremely portable for any mode of transportation.

1 Claim, 1 Drawing Sheet

Figure 1:
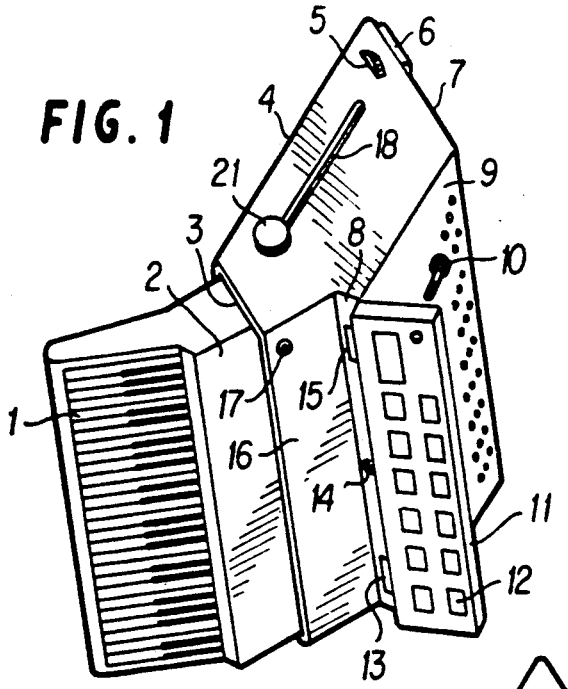

DOUBLE CHAMBERED BASSBOARD HOUSING FOR ELECTRONIC M.I.D.I. ACCORDION WITH RETRACTABLE KEYBOARD

BRIEF SUMMARY OF THE INVENTION

The double chambered bassboard housing for electronic M.I.D.I. accordion (M.I.D.I. stands for: Musical Instrument Digital Interface) with retractable keyboard also incorporates a folding control panel. The double chambered bassboard, as the title implies, consists of two parallel chambers divided, in their entirety, by a solid partition. The longer left portion of the front chamber houses a considerably smaller electronic bassboard mechanism (which utilizes a much shorter type of piston assembly then the one used in the traditional acoustic accordions) and the smaller right portion of the front chamber takes the form of a step-down (sunken-in) narrow rectangular slanted surface which leaves behind, from the entirety of its longitudinal edge, a ½" high riser and gradually sloping inwardly in a rightward direction it merges with its rightmost edge, lengthwise, with the rightmost edge of the afore mentioned solid partition which divides the two chambers. This slanted narrow rectangular surface provides the precise amount of space that the narrow rectangular folding control panel with matching dimensions requires and the ½" high riser provides the necessary surface to be fastened, lengthwise by means of two small hinges, to one of the two ½" wide longitudinal edges of same folding control panel.

The rear chamber is designed to provide enough room, in its extreme lower left corner, for the instrument's main plug attachment and pertinent wiring and to allow enough space for the bass strap apparatus (located within the top left portion of same rear chamber) and to reserve the remaining three quarters, of the vacant area, for the retractable keyboard. The slightly diagonally oriented three main vertical surfaces (the back and the left surfaces and the left portion of the front surface) together with the slightly curved contour of the keyboard housing's are intended to improve adherence to the accordionist's body curvature for added comfort. The previously mentioned folding control panel, once that it swings out into a fully open position, its control panel faces laterally rightward with a diagonal slant toward the far right edge of the keyboard thus becoming fully visible to the eyes of the accordionist and therefore improving efficiency. The instrument retains the traditional bass strap which, however, is now positioned near the rear portion (instead of the traditional mid portion) of the left end panel of the double chambered bassboard housing. The guiding linear tracks (cut out of the rear portion of the top and the bottom surface of the double chambered bassboard housing), determine the degree of extendability and retractability of the keyboard housing within the vacant space of the rear chamber. The keyboard housing's electronic circuit is connected to the electronic components of both the bassboard and the folding control panel by a coiled wire. The instrument needs only a single back strap.

The double chambered bassboard housing for electronic M.I.D.I. accordion with retractable keyboard can be made out of wood or out of different hard-impact plastic materials and even aluminum or other extremely light types of metal can be utilized to reduce even more the weight factor and the bulk factor for maximum results. When the keyboard is locked in a fully extended position, the instrument is very light on the accordionist's shoulders and most practical to perform with. When the keyboard is fully retracted, its overall size is considerably reduced and it becomes a perfect travel companion—compact enough to be stored in most over-head or under-the-seat luggage compartments.

A BRIEF DESCRIPTION OF THE SEVERAL VIEWS OF THE DRAWINGS

Enclosed are the three drawings for reference purposes named FIG. 1, FIG. 2, FIG. 3, and FIG. 4.

FIG. 1 illustrates the front view of the instrument in a fully open position. In particular it reveals both the bass strap and its regulator (Part 6 and Part 5) positioned, in that order, on the rear outer edge of Part 7 (the bassboard housing's end panel) and on the left corner of the bassboard housing's top surface. Part 16 is the step-down slanted rectangular surface which, together with Part 8 (its adjacent longitudinal riser), provides a recessed sunken-in area that protects Part 12 (the folding control panel) when folded down in a closed position. Part 17 is the small perforation (on the top right portion of Part 16) which interacts with its matching locking device (Part 10), placed, in the form of a small knob with a machine screw stem, in the top right section of Part 12 (the folding control panel), to secure same in a closed position. Part 13 and Part 15 are the two small hinges used to fasten the opposite surface of Part 11 (one of the two longitudinal edges of Part 12 the folding control panel) to Part 8 the riser's surface. Part 14 is the small wire which, by passing through a perforation in the mid section of Part 8 (the riser), gains access to Part 12 (the folding control panel) through a second perforation in the mid section of the narrow surface directly opposite Part 11 (one of the two longitudinal edges of the folding control panel) thus establishing a connection between Part 12 (the folding control panel) and Part 9 the bassboard mechanism.

Figure 2:
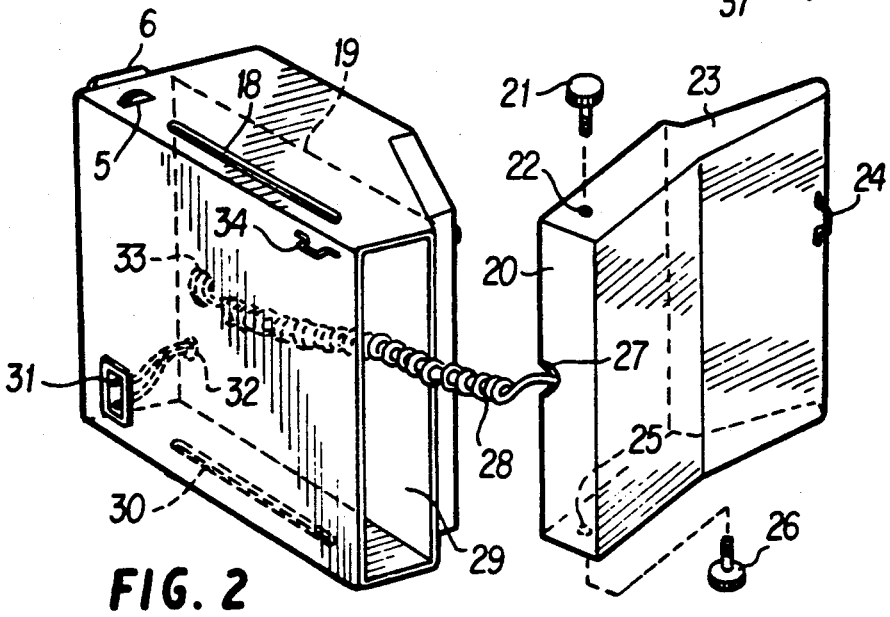

FIG. 2 displays Part 18 and Part 30 the top and bottom linear guiding tracks. Part 19 is the dotted line indicating the position of the partition dividing the front and the rear chambers. Part 21, Part 22, Part 25, and Part 26 are the components that together with Part 18 and Part 30 make it possible for the keyboard housing to extend and retract within the rear chamber (Part 29). Part 33 is the circular cavity carved out of Part 19 (the partition dividing the two chambers) that together with Part 27 a double-sided semicircular cavity carved out of the mid frontal edge of the far end panel of the keyboard housing (Part 20) and out of the merging far left mid section of the keyboard housing's front panel (Part 2, FIG. 1), provide the two apertures necessary for the coiled cable (Part 28) to link the electronic components of the front chamber (bassboard mechanism and the folding control panel) to the electronic circuit of the keyboard housing. Part 34 and Part 24 are the two attachments of the single back strap required for this instrument and Part 31 is the main plug of the instrument. Part 32 is the small cavity (in the lower left portion of Part 19 namely the solid partition dividing the two chambers) that allows the main plug to be connected, by small wires, to the electronic components of the front chamber.

Figure 3:
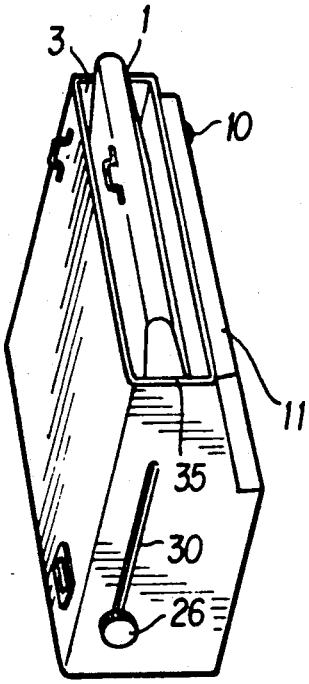

FIG. 3 exhibits the double chambered housing for electronic M.I.D.I. accordion with its keyboard fully retracted and its folding control panel in a closed position.

Figure 4:
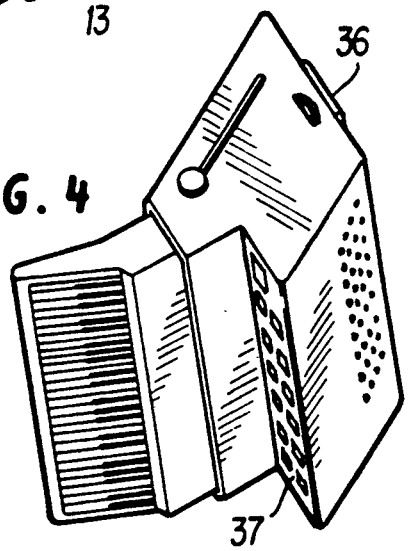

FIG. 4 simply highlights a slightly different version of the double chambered bassboard housing for electronic M.I.D.I. accordion with retractable keyboard showing a somewhat deeper front chamber that allows the formation of a lateral surface with enough room to accommodate, in this case, a stationary control panel (Part 37) and the bass strap (Part 36) being repositioned back to the traditional mid section of the left end panel of the bassboard housing.

DETAILED DESCRIPTION OF THE DOUBLE CHAMBERED BASSBOARD HOUSING FOR ELECTRONIC M.I.D.I. ACCORDION WITH RETRACTABLE KEYBOARD

The double chambered bassboard housing for electronic M.I.D.I. accordion with retractable keyboard utilizes a standard accordion bassboard mechanism (which requires only about one third of the amount of space normally needed by the traditional bassboard mechanism with much longer pistons) arranged in the left front portion of its front chamber Part 9, FIG. 1. Said left portion of said front chamber, about 2½" to 3" deep, extends, from the frontal longitudinal edge of Part 7, FIG. 1 (the end panel of the double chambered bassboard housing), in a laterally outward direction to a width of about 5" and at this point it forms, lengthwise, a ½" high riser (Part 8, FIG. 1) by dropping and creating, longitudinally, a lower level narrow rectangular surface (Part 16, FIG. 1) sloping inwardly and expanding rightward to a width of about 3" and merging, longitudinally with its rightmost edge, with the rightmost edge of the solid partition (Part 19, FIG. 2) which divides, longitudinally and latitudinally, the left portion of the front chamber (Part 9, FIG. 1) and the right lower level portion of the front chamber (Part 16, FIG. 1), from Part 29, FIG. 2 namely the rear chamber. Part 16, FIG. 1 (the lower level narrow rectangular surface) together with Part 8, FIG. 1 (the ½" high riser) provides a protective recessed surface for the matching dimentions of Part 12, FIG. 1 (the folding control panel). Part 13 and Part 15, FIG. 1 are the two small hinges that secure one of the two ½" wide longitudinal edges of the folding control panel (Part 12, FIG. 1) to the matching ½" high riser Part 8, FIG. 1. Part 17, FIG. 1 and Part 10, FIG. 1 are, in that order, the perforation containing a small tee-nut and the small machine screw (with matching stem topped by a little knob) that perform together as a simple locking device for the folding control panel (Part 12, FIG. 1). Part 14, FIG. 1 is the small wire linking the folding control panel circuit to the bassboard electronic components and Part 8, FIG. 1 (the ½" high riser) and the opposite surface of Part 11, FIG. 1 (one of the two longitudinal edges of the folding control panel) supply the two surfaces containing the two small holes necessary for the small linking wire to pass through. Part 19, FIG. 2 (the solid partition dividing the two chambers) stands vertically almost directly opposite to Part 4, FIG. 1 (the back surface of the rear chamber) however, its parallel position with regard to said back surface of the rear chamber is shifted slightly to the right, and so are its two (left and right) vertically oriented longitudinal edges which in conjunction with Part 7, FIG. 1 (the bassboard housing's end panel), Part 9, FIG. 1 (the bassboard housing's left front panel) and Part 4, FIG. 1 (the bassboard housing's back panel) form a diagonally oriented housing comprising 5 vertically oriented outer surfaces of equal length and of dissimilar width and two surfaces (top and bottom) of identical shape with six sides each, five of which matching perfectly said five extreme top and bottom ends of said dissimilar vertically oriented outer surfaces and the sixth side (indicated by Part 3, FIG. 1 and by Part 35, FIG. 3) remaining fully open because only connecting, at the top, the top rightmost edge of Part 16, FIG. 1 (the lower level rectangular surface) to the top rightmost edge of Part 4, FIG. 1 (the back panel of the rear chamber) and at the bottom, the bottom rightmost edge of Part 16, FIG. 1 (the lower level rectangular surface) to the bottom rightmost edge of Part 4, FIG. 1 (the back panel of the rear chamber) thus giving shape to a vertically oriented elongated rectangular lateral opening Part 29, FIG. 2. The double chambered housing for electronic M.I.D.I. accordion also utilizes a standard size keyboard and said keyboard expands, lengthwise, into a very short elongated rectangular housing (Part 20, FIG. 2) that fits exactly through the just described elongated rectangular lateral opening of the rear chamber Part 29, FIG. 2 which, like the left portion of the front chamber, is about 2½" to 3" deep. Part 18 and Part 30, FIG. 2 (the top and bottom linear guiding tracks cut out of the rear portion of the top and bottom surface of the double chambered housing for electronic M.I.D.I. accordion) and Part 21 and Part 26, FIG. 2 (the top and bottom machine screws with round flat knobs) together with Part 22 and Part 25, FIG. 2 (the top and the bottom corresponding tee-nuts of same size positioned into the left portion of the top surface (Part 23, FIG. 2) of the keyboard housing and on the directly opposite bottom surface of same keyboard housing), create a locking and releasing manual control which governs the retractable keyboard inside the rear chamber within the limits imposed by Part 18 and Part 30, FIG. 2 (the top and the bottom linear guiding tracks) that prevents the keyboard housing's organized bilateral moveability, from interferring with the longitudinal far left portion of the rear chamber which contains Part 5, FIG. 1 the bass strap apparatus and Part 31, FIG. 2 (the main plug attachment) with its wires gaining access to the front chamber by passing through Part 32, FIG. 2 (the small perforation drilled in the lower left portion of Part 19, FIG. 2 the solid partition dividing the two chambers). Part 27, FIG. 2 is the double-sided semicircular opening carved out of the frontal mid portion of Part 20, FIG. 2 (the elongated rectangular end panel of the keyboard housing) and out of the mid far left portion of Part 2, FIG. 1 (the front panel of the keyboard housing), and Part 33, FIG. 2 is the circular opening cut out of the far left mid portion of Part 19, FIG. 2 (the solid partition dividing the two chambers of the bassboard housing) and together these two openings provide Part 28, FIG. 2 (the coiled connector cable) with safe access to both the bassboard mechanism and the folding control panel at one end and to the keyboard housing's electronic components at the other end. Part 34, FIG. 2 is the upper back strap attachment (positioned on the top right corner of the rear chamber's back surface Part 4, FIG. 1) and Part 24, FIG. 2 is the second of the two back strap's attachments needed which is fastened to a point just above the mid section of the keyboard housing's rightmost rear edge. Once the back strap is fastened to the top attachment (Part 34, FIG. 2), it climbs over the left shoulder of the accordionist moving across the back rightward hugging the upper right side of the accordionist (just below the right arm) to immediately reach and engage Part 24, FIG. 2 the second attachment. Part 31, FIG. 2 is the main plug for the M.I.D.I. cable. When the M.I.D.I. cable is plugged in, is always on the left side of the accordionist and therefore conveniently out of the accordionist's way.

FIG. 3 shows the instrument in a fully closed position.

I claim:

1. A double chambered bassboard housing for electronic M.I.D.I. accordion with retractable keyboard housing and with a folding control panel; said retractable keyboard housing consisting of a standard electronic M.I.D.I. accordion keyboard having a longitudinal outer edge and a longitudinal inner edge; said keyboard extending, lengthwise, from said longitudinal inner edge into a short rectangular housing comprising a top and a bottom narrow surface and a front and a back surface; said back surface having a leftmost and a rightmost longitudinal edge; said short rectangular housing containing in mid section a double-sided front-lateral semicircular access hole large enough to allow a coiled wire to move freely within said semicircular access hole, and said retractable keyboard housing also incorporating a top and a bottom tee-nut imbedded in a far left portion of said top and bottom narrow surface, and said rightmost edge of said back surface containing right above mid point one of two attachments supporting a single back strap; said double chambered bassboard housing consisting of a rear chamber and a front chamber internally separated by a solid rectangular partition containing a circular perforation large enough to allow a coiled wire to extend and retract freely within a circumference of said circular perforation and a second smaller cavity accommodating a central wiring of said double chambered bassboard housing; said solid rectangular partition having a longitudinal rightmost edge, a longitudinal leftmost edge and a shorter top and bottom edge; said double chambered bassboard housing comprising a top and a bottom surface, a rear surface, a left side panel, an outwardly slanted rectangular left front panel having a left and a right longitudinal edge, said right longitudinal edge merging, lengthwise, with one of the two longitudinal edges of a half inch wide surface facing laterally and the second longitudinal edge of said half inch surface merging with one of the two longitudinal edges of a recessed narrower, inwardly slanted rectangular right front panel; said right front panel's second longitudinal edge merging with said solid rectangular partition's rightmost longitudinal edge; said solid rectangular partition's leftmost longitudinal edge joining, lengthwise, the mid section of said left side panel's inner surface of said double chambered housing and the remaining shorter top and bottom edge of said solid rectangular partition joining with a mid section of the inner surface of said top and bottom surface of said double chambered housing; said double chambered housing consisting of a left front chamber, a narrower right front recessed, inwardly slanted surface containing said folding control panel, and a larger rear chamber; said left front chamber containing a electronic bassboard mechanism and said narrower inwardly slanted recessed right front panel providing a right amount of recessed area for said folding control panel to rest on and swing out from by means of hinges connecting one of the two longitudinal edges of said folding control panel to said half inch wide surface; said hinged longitudinal edge of said control panel and said half inch wide surface both containing, about mid section, one small perforation facilitating the electronic connection of said folding control panel to both said bassboard mechanism and said keyboard housing by means of small wires; said folding control panel incorporating a machine screw-like locking apparatus interlocking with a matching tee-nut imbedded directly below in said narrower, inwardly slanted right front panel's surface; said rear chamber comprising a rectangular back surface containing the main plug in the lower left corner and containing the second one of the two attachments supporting said single back strap, in the top right corner, a left side surface consisting of the rear longitudinal half portion of said left side panel of said double chambered bassboard housing and a front panel consisting of said solid rectangular partition, a top and a bottom panel consisting of the rear half portion of said top and bottom surface of said double chambered bassboard housing, and a fully open rectangular right side; the far left portion of said top surface of said rear chamber containing a regulator of the bass strap, and said open rectangular right side functioning as a receiving conduit within which said rectangular keyboard housing retracts and extends; said top and bottom surface of said rear chamber each incorporating a straight cut in the form of a carved-out narrow linear guiding track; said rectangular keyboard housing's degree of mobility within the limits imposed by said rear chamber's top and bottom linear guiding track being governed by a top and a bottom flat round knob with machine screw stem passing through said top and bottom linear guiding track and interacting with the respective top and bottom tee-nut imbedded in the far left portion of said top and bottom narrow surface of said rectangular keyboard housing's brief extension; by means of a coiled wire passing through said solid rectangular partition's circular perforation and through said rectangular keyboard housing's double-sided front-lateral semicircular access hole, constant electronic contact is maintained between said rectangular keyboard housing and said double chambered bassboard housing.

* * * * *